United States Patent [19]

John

[11] 4,033,307

[45] July 5, 1977

[54] PROCESS AND DEVICE FOR PREPARING IGNITABLE FUEL MIXTURES

[75] Inventor: Veit John, Wiesbaden, Germany

[73] Assignee: Hoechst Aktiengesellschaft, Frankfurt am Main, Germany

[22] Filed: July 8, 1975

[21] Appl. No.: 594,129

[30] Foreign Application Priority Data

July 10, 1974 Germany ..... 2433061
Oct. 30, 1974 Germany ..... 2451470

[52] U.S. Cl. ..... 123/119 A
[51] Int. Cl.[2] ..... F02M 25/06
[58] Field of Search ..... 261/44 R, 18 R, 18 A; 123/119 A, 127

[56] References Cited

UNITED STATES PATENTS

| | | | |
|---|---|---|---|
| 1,444,222 | 2/1923 | Trego | 261/44 R |
| 1,983,957 | 12/1934 | White | 261/18 R |
| 2,621,029 | 12/1952 | Moseley | 261/18 R |
| 3,444,846 | 5/1969 | Sarto et al. | 123/119 A |
| 3,507,260 | 4/1970 | Walker | 123/119 A |
| 3,765,658 | 10/1973 | Hartel et al. | 261/44 R |
| 3,820,514 | 6/1974 | Kuehl | 123/119 R |
| 3,858,842 | 1/1975 | Yoshimura | 123/119 A |

FOREIGN PATENTS OR APPLICATIONS

| | | | |
|---|---|---|---|
| 2,452,619 | 11/1974 | Germany | 261/50 A |
| 2,433,061 | 7/1974 | Germany | 261/18 R |

*Primary Examiner*—Wendell E. Burns
*Attorney, Agent, or Firm*—Curtis, Morris & Safford

[57] ABSTRACT

Mixtures having good ignition quality and consisting of fuels with different calorific values, for example gasoline and methanol, for internal combustion engines are prepared by admixing the fuel mixture, in accordance with its calorific value, with atmospheric oxygen over at least one dosing device, for example a nozzle. If desired hot exhaust gas can be added to the fuel in an amount depending on the load on the engine. The mixture is then fed in known manner to the internal combustion engine.

5 Claims, 3 Drawing Figures

PROCESS AND DEVICE FOR PREPARING IGNITABLE FUEL MIXTURES

Figure 1:
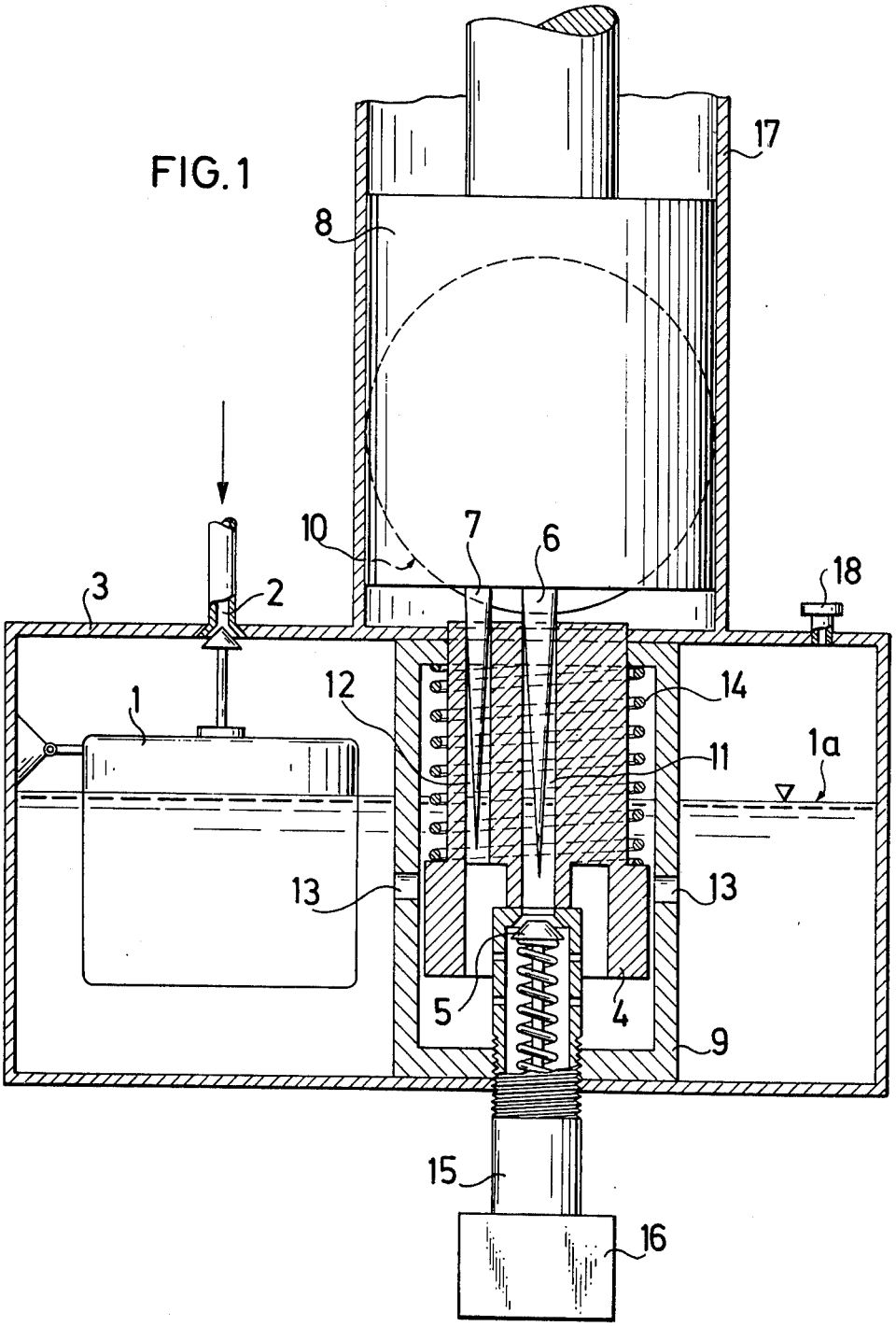

This invention relates to a process and device for preparing ignitable mixtures from fuels with different calorific values, more particularly mixtures having good ignition quality and consisting of monohydric saturated aliphatic alcohols having from 1 to 4 carbon atoms and carburetor fuels for internal-combustion engines.

As a result of the shortage of raw material for the manufacture of carburetor fuels the research for substitution products for gasoline have been increased. It appears to be actually impossible for various reasons to replace gasoline quantitatively by other fuels, for example methanol, and therefore, the operation of a dual-fuel engine has been discussed lately. But the solution of the problem to operate internal-combustion engines with a fuel consisting of a mixture of methanol and gasoline in any desired proportion, possibly with a proportion of methanol of from 0 to 100% by weight, comes up against technical difficulties which could not yet be overcome.

Therefore, it is the object of the present invention to provide mixtures of carburetor fuels and monohydric saturated aliphatic alcohols in which the alcohol proportion optionally amounts from 0 to 100% by weight, which mixtures are suitable to operate internal-combustion engines.

It is a further object of the present invention to provide a device suitable to prepare the aforesaid mixtures for the combustion in engines for carburetor fuel.

Owing to the high heat of evaporation of methanol of 265 kcal per kilogram a pre-heating of the ignitable fuel mixture is necessary. It has been found in practice that in the operation with methanol the pre-heating by the air heated by indirect heat exchange on the collecting pipe of the exhaust gases is insufficient. This type of preheating does not take into account the load-dependent heat requirement of the mixture. It is, therefore, another object of the present invention to provide a process for pre-heating the fuel mixture and a suitable device therefor.

In accordance with the present invention a process for preparing ignitable mixtures of fuels with different calorific values for internal combustion engines has been found, which comprises admixing the fuel according to its calorific value with atmospheric oxygen over at least one dosing device to obtain an ignitable mixture and feeding the mixture in known manner to an internal-combustion engine.

Fuels consisting of monohydric saturated aliphatic alcohols having from 1 to 4 carbon atoms, for example methanol, ethanol, butanol, propanol, and isopropanol are admixed with atmospheric oxygen over two dosing devices to obtain an ignitable mixture. Fuel mixtures of the said alcohols with gasoline containing about 25 to 75% by weight of alcohol are admixed with atmospheric oxygen in like manner. With mixtures in which the alcohol proportion is below 25% by weight only one dosing device is necessary.

It has also been found that when feeding the mixture into the internal-combustion engine hot gases can be admixed in an amount depending on the load on the engine. A very practicable method consists in adding hot exhaust gases of the engine to the mixture in an amount depending on the engine load.

The device for preparing ignitable mixtures of fuels having different calorific values in internal-combustion engines comprises a float chamber with dosing device in the interior, the said dosing device being immersed in the fuel and having at least two bores, nozzle pins arranged above the bore holes to vary the free cross sections thereof, a piston movable in the direction of the bores and connected with the nozzle pins, at least one of the bore holes being provided with closing means independent of the variation of the free cross sectional areas, and a suction tube into which the bores discharge.

In a further embodiment of the device for preparing ignitable mixtures from fuels of different calorific values a dosing device for hot gases, working in accordance with the engine load, is mounted in the suction tube between the displaceable piston with which the nozzle pins are connected and the internal combustion engine, said dosing device consisting of an inlet pipe for hot gas and a casing, an element movably mounted in the interior of the said casing, which element is under atmospheric pressure on one side and under the pressure of the suction tube on the other side, a piston rod connected with the element and protruding into the suction tube, and a piston valve at the free end of the piston rod to close the inlet pipe.

When methanol is used as fuel for engines for carburetor fuels the lower calorific value, the high heat of evaporation and the high ignition temperature must be taken into consideration. The calorific value of gasoline is 9,800 to 10,200 kilocalories per kilogram. This corresponds to 2.1 to 2.2 times the calorific value of methanol which is about 4,700 kilocalories per kilogram. The theoretical air consumption of the two fuels has an approximately equal proportion. With methanol as well as with gasoline or mixture thereof the engines must be operated under conditions under which the air-fuel mixture is unobjectionably burned.

The high evaporation heat of methanol of 265 kilocalories per kilogram necessitates pre-heating of the methanol to render possible a cold start or to prevent too high losses of injected condensed fuel. The high ignition temperature together with a slow combustion require a high performance ignition system with advanced moment of ignition.

When the engine is operated with methanol alone the fuel energes from both bores of the dosing device the dimensions of which are such that the difference in the calorific values of methanol and gasoline is taken into consideration. When the engine is run with gasoline, the second bore is closed by a valve and the fuel emerges from one bore only.

It is of advantage to use a transistor ignition device permitting an enlargement of the spark-plug gap. With methanol, the pre-ignition must be considerably advanced, which can be done, for example, with an advanced adjustment of vacuum which is likewise coupled with the carburetor change and the pre-heating.

To ensure a ready starting of the engine at temperatures below 0° C it is expedient to provide for a cold start device using gasoline as starting fuel and injecting the gasoline directly into the suction tube during the start, the injection being regulated by a thermometric time switch.

Figure 2:
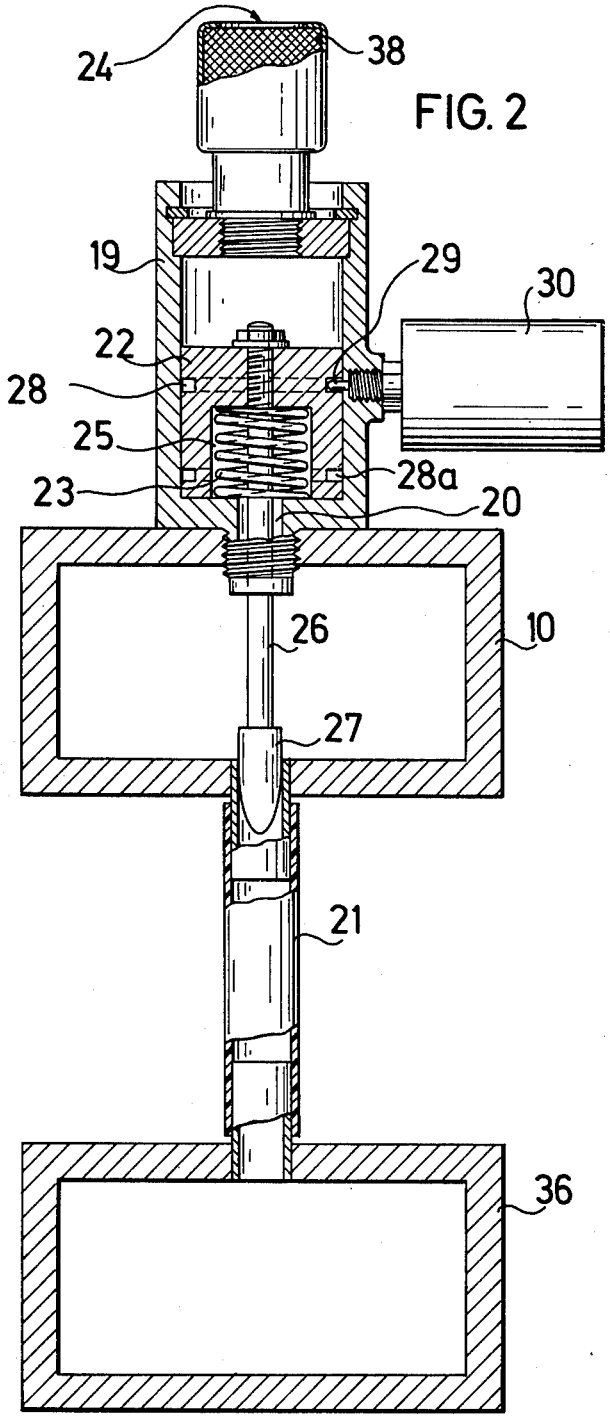
Figure 3:
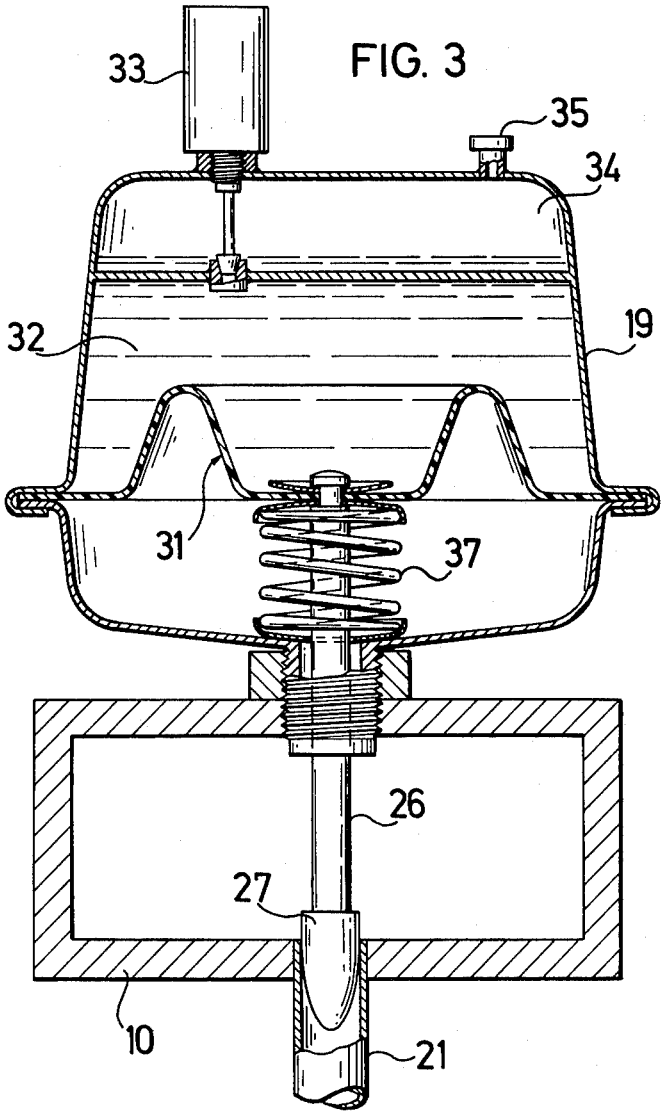

The device for preparing an ignitable mixture and for its pre-heating will now be described in further detail and by way of example with reference to the accompanying drawings of which FIG. 1 is a cross sectional elevation of a device for preparing the ignitable mixture FIG. 2 is a cross sectional elevation of a device for preheating the mixture by means of hot gases and FIG. 3 is a cross sectional elevation of a further embodiment of the device for preheating the fuel mixture.

The fuel passes into the float chamber 3 through needle valve 2. In the chamber the desired level 1*a* is maintained by float 1. From the float chamber 3 the fuel travels through connecting channel 13 into the casing 9 for the dosing device 4 and to the bores 11 and 12 of the said dosing device 4. The fuel reaches the suction tube 10 through bores 11 and 12 and in the suction tube it is mixed with atmospheric oxygen. The nozzle pins 6 and 7 are firmly connected with a piston 8 mounted above the suction tube 10. Piston 8 moves in accordance with the engine performance and displaces dosing needles 6 and 7 in bores 11 and 12. By the shape of the nozzle pins the free cross sectional area of bores 11 and 12 is varied in accordance with the load on the engine. Piston 8 can be operated by pneumatic, hydraulic, electric and/or mechanic means. It is guided in the carburetor casing 17 in the direction of the bores 11 and 12.

The closing means 5 for bore 11 can be operated pneumatically, hydraulically, electrically, or mechanically. The casing 9 for the dosing device 4 is mounted in float chamber 3 in such a manner that bores 11 and 12 open into suction tube 10. The interior of float chamber 3 is under atmospheric pressure over ventilating aperture 18. Casing 9 communicates with the interior of float chamber 3 by connecting channels 13 in the portion of casing 9 immersed in the fuel. Numeral 14 indicates a spring to hold dosing device 4 in casing 9. Numeral 15 represents means to adjust idling and 16 indicates the drive for closing means 5.

When the engine is operated with methanol, closing means 5 is open so that the fuel can pass into suction tube 10 through bores 11 and 12.

With a gasoline operation, closing means 5 seals bore 11 so that the fuel can only pass into suction tube 10 through bore 12.

With determined mixing proportions of gasoline and methanol it can be advantageous to dose by closing means 5 the fuel mixture running through bore 11 independent of the position of the nozzle pins.

Referring to FIG. 2, the casing 19, which is preferably of cylindrical shape, of the device for preheating the fuel mixture is installed at the suction tube 10 of the internal-combustion engine. Its interior is directly connected with the gas space of the suction tube by opening 20. Opposite opening 20, the inlet 21 for the hot gas discharges into suction tube 10. In casing 19 a piston 22 loaded by spring 24 is mounted. One end face of piston 22 is under atmospheric pressure over opening 24, while at the other end face of piston 22 the pressure of suction tube 10 prevails by means of opening 20. The end face of the piston turned towards the suction pipe is provided with a recess 25 in which a pressure spring 23 is located. The recess and the pressure spring have a dimension such that the pressure spring can rest on the bottom of casing 19 facing the suction tube. Piston 22 is provided with a piston rod 26 protruding into the gas space of suction tube 10 and carrying at its end a piston valve 27 to shut supply pipe 21 for the hot gas. The running surface of piston 22 is provided with annular groves 28, 28*a* into which engages an arresting pin 29 which can be operated by an electromagnet 30 fitted on casing 19. Numeral 38 indicates a filter.

Referring now to FIG. 3, in the device for admixing hot gas to the ignitable mixture in an amount dependent on the engine load, piston 22 and spring 23 are replaced by a diaphragm 31. In this case, piston rod 26 is not arrested by arresting pins but by a liquid 32, for example a hydraulic fluid, above diaphgram 31, which liquid can be controlled by a valve 33, for example a magnetic valve, in accordance with the operating condition of the engine. Numeral 34 indicates the equalizing chamber and numeral 35 a pressure compensating aperture for the liquid 32. Spring 37 constitutes the counterweight to the pressure of liquid 32.

According to FIG. 2 the hot gas from exhaust pipe 36 is conducted to suction tube 10 via pipe 21. It is likewise possible, of course, to use any other gas after heating to the required temperature.

When the internal-combustion engine is started and when it is idling, pipe 21 is closed so that no exhaust gas from exhaust pipe 36 can pass into suction tube 10. By opening the throttle valve of the carburetor the vacuum in the suction tube diminishes according to the position of the valve and spring 23 presses piston 22 against the side under atmospheric pressure; pipe 21 is opened depending on the load. In order that pipe 21 is closed with certainty when the engine is started, at which moment the supply of foreign gas in the suction tube and in the carburetor could be especially unfavorable owing to the change of the pressure conditions, piston 22 can be held in closing position by arresting pin 29. After termination of the starting phase, the arresting pin 29 is withdrawn from the annular grove 28, for example with the aid of an electromagnet 30. It can be of advantage to provide for possibilities to arrest the piston by pins also in its uppermost position so that hot foreign gas can be added to the ignitable mixture also at temperatures below the working temperature of the engine when it is idling. The piston is therefore provided with a second annular grove 28*a* in which the arresting pin 29 can engage. As soon as the operating temperature is reached, the piston is released and the hot gases can be added to the ignitable mixture in an amount depending on the load on the engine. With full load pipe 21 is completely opened.

What is claimed is:

1. A device for preparing an ignitable mixture of fuels having different calorific values in internal-combustion engines, comprising a float chamber and a dosing device in the interior of said chamber and immersed in the fuel, the dosing device being provided with at least two bores, nozzle pins above the said bores by means of which the free cross sectional areas of the bores are varied, a piston slidable in the direction of the bores with which the nozzle pins are connected, closing means for at least one bore to shut the bore(s) independent of the variation of the free cross sectional area thereof, and a suction tube into which the bores discharge.

2. The device claimed in claim 1, in which the suction tube between the piston actuating the nozzle pins and the internal-combustion engine a dosing device for hot gases is mounted, which dosing device is operated in dependency on the load on the engine and comprises an inlet pipe for hot gas and a casing, an element movably mounted in the interior of said casing, the said element being under atmospheric pressure on one side and under the pressure of the suction tube on the other side, a piston rod connected with the said element and protruding into the suction tube and a piston valve at the free end of the piston rod to close the inlet pipe.

3. The device as claimed in claim 2, wherein the movable element is a piston which is actuated on the side of the suction tube by means of a pressure spring.

4. The device as claimed in claim 2, wherein the piston is provided with at least one annular grove in its running surface for an electrically controlled arrest.

5. The device as claimed in claim 2, wherein the movable element in the casing of the dosing device is a diaphragm which is in communication with the atmospheric pressure over a liquid.

* * * * *